US010267508B2

(12) United States Patent
Balanchi

(10) Patent No.: US 10,267,508 B2
(45) Date of Patent: Apr. 23, 2019

(54) ILLUMINATED TRACK SYSTEM

(71) Applicant: MINDSCOPE PRODUCTS, Pacoima, CA (US)

(72) Inventor: George Balanchi, Pasadena, CA (US)

(73) Assignee: MINDSCOPE PRODUCTS, Pacoima, CA (US)

( * ) Notice: Subject to any disclaimer, the term of this patent is extended or adjusted under 35 U.S.C. 154(b) by 393 days.

(21) Appl. No.: 15/330,760

(22) Filed: Nov. 4, 2016

(65) Prior Publication Data

US 2018/0128477 A1 May 10, 2018

(51) Int. Cl.

| | |
|---|---|
| ***A63H 18/02*** | (2006.01) |
| ***F21V 33/00*** | (2006.01) |
| ***F21V 21/005*** | (2006.01) |
| ***F21V 23/02*** | (2006.01) |
| ***F21V 23/06*** | (2006.01) |
| ***A63H 33/22*** | (2006.01) |
| *F21Y 115/10* | (2016.01) |

(52) U.S. Cl.

CPC ..... *F21V 33/008* (2013.01); *A63H 18/02* (2013.01); *A63H 33/22* (2013.01); *F21V 21/005* (2013.01); *F21V 23/02* (2013.01); *F21V 23/06* (2013.01); *F21Y 2115/10* (2016.08)

(58) Field of Classification Search

CPC ..... A63H 17/28; A63H 18/02; A63H 18/021; A63H 33/22; F21V 21/005; F21V 33/008

USPC ..... 362/153.1; 238/10 F

See application file for complete search history.

(56) References Cited

U.S. PATENT DOCUMENTS

| | | | | | |
|---|---|---|---|---|---|
| 4,095,743 | A * | 6/1978 | Birdsall | A63H 18/12 | 238/10 F |
| 4,225,081 | A * | 9/1980 | Ikegame | A63H 19/30 | 238/10 B |
| 4,241,875 | A * | 12/1980 | Vandenbrink | A63H 18/02 | 104/60 |
| 4,372,489 | A * | 2/1983 | Lee | A63H 18/02 | 238/10 E |
| 4,941,610 | A * | 7/1990 | Frauca | A63H 18/02 | 238/10 A |
| 5,160,091 | A * | 11/1992 | Hesse | A63H 18/02 | 191/22 C |
| 5,846,117 | A * | 12/1998 | McGaffigan | A63H 17/28 | 446/219 |
| 6,382,519 | B1 * | 5/2002 | Choi | A63H 18/02 | 238/10 F |
| 6,631,850 | B1 * | 10/2003 | Wa | A63H 18/021 | 104/60 |

(Continued)

*Primary Examiner* — Zachary L Kuhfuss

(74) *Attorney, Agent, or Firm* — Jonathan E. Grant; Grant Patent Services

(57) ABSTRACT

An illuminated track system is disclosed, comprising plurality of track segments. Each track segment is composed of a floor, with the floor comprising a front section, said front section comprising a coupler, a back section, said back section comprising a coupler mouth, an underside, said undersiding comprising a first conductive contact connecting said coupler to said coupler mouth and a second conductive contact connecting said coupler to said coupler mouth, a top section and at least one illumination bulb, said positioned from said underside and connected to said first conductive contact and to said second conductive contact. A power source is connected to an assembly of said plurality of said track segments, such that the assembly forms a closed circuit.

15 Claims, 13 Drawing Sheets

(56) References Cited

U.S. PATENT DOCUMENTS

| | | | | |
|---|---|---|---|---|
| 7,051,948 | B2 * | 5/2006 | Wa | A63H 18/021 238/10 A |
| 7,285,035 | B1 * | 10/2007 | Tullis | A63H 18/026 446/444 |
| 9,162,155 | B2 * | 10/2015 | Platzer | A63H 18/16 |
| 2007/0037478 | A1 * | 2/2007 | Zane | A63H 18/021 446/444 |
| 2007/0070618 | A1 * | 3/2007 | Talamo | E01F 9/582 362/153.1 |
| 2014/0357155 | A1 * | 12/2014 | Koehl | A63H 18/08 446/444 |
| 2015/0224418 | A1 * | 8/2015 | Musliner | A63H 18/02 446/118 |
| 2018/0128477 | A1 * | 5/2018 | Balanchi | A63H 18/02 |

* cited by examiner

ILLUMINATED TRACK SYSTEM

In the present disclosure, an illuminated track system is disclosed. This track system can be used as a toy track for toy automobiles or model railroads.

The figures depict various embodiments of the described methods and system and are for purposes of illustration only. One skilled in the art will readily recognize from the following discussion that alternative embodiments of the methods and systems illustrated herein may be employed without departing from the principles of the methods and systems described herein.

DETAILED DESCRIPTION OF THE EMBODIMENT

Figure 1:
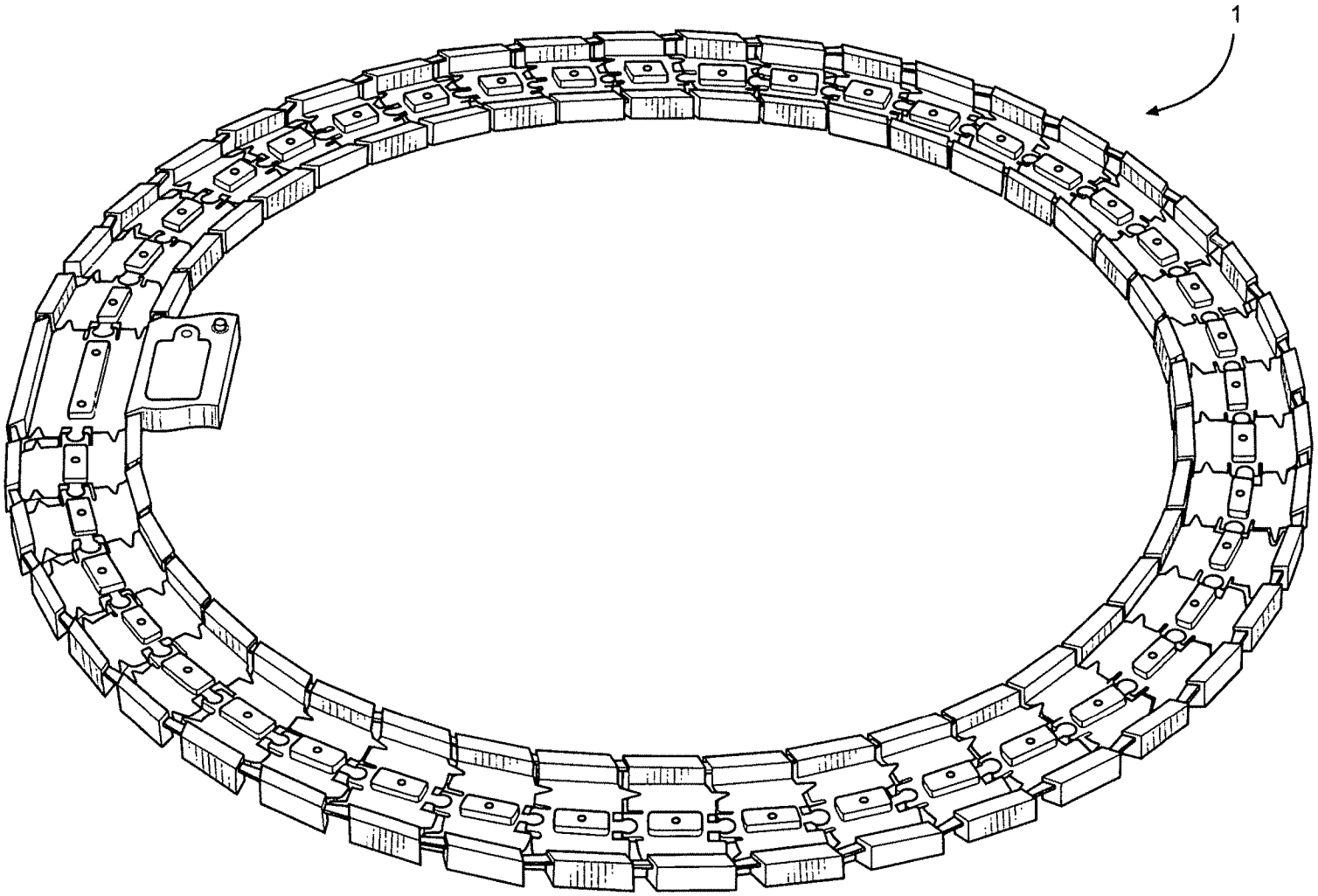
FIG. 1 is a perspective view of the track system.
Figure 2:
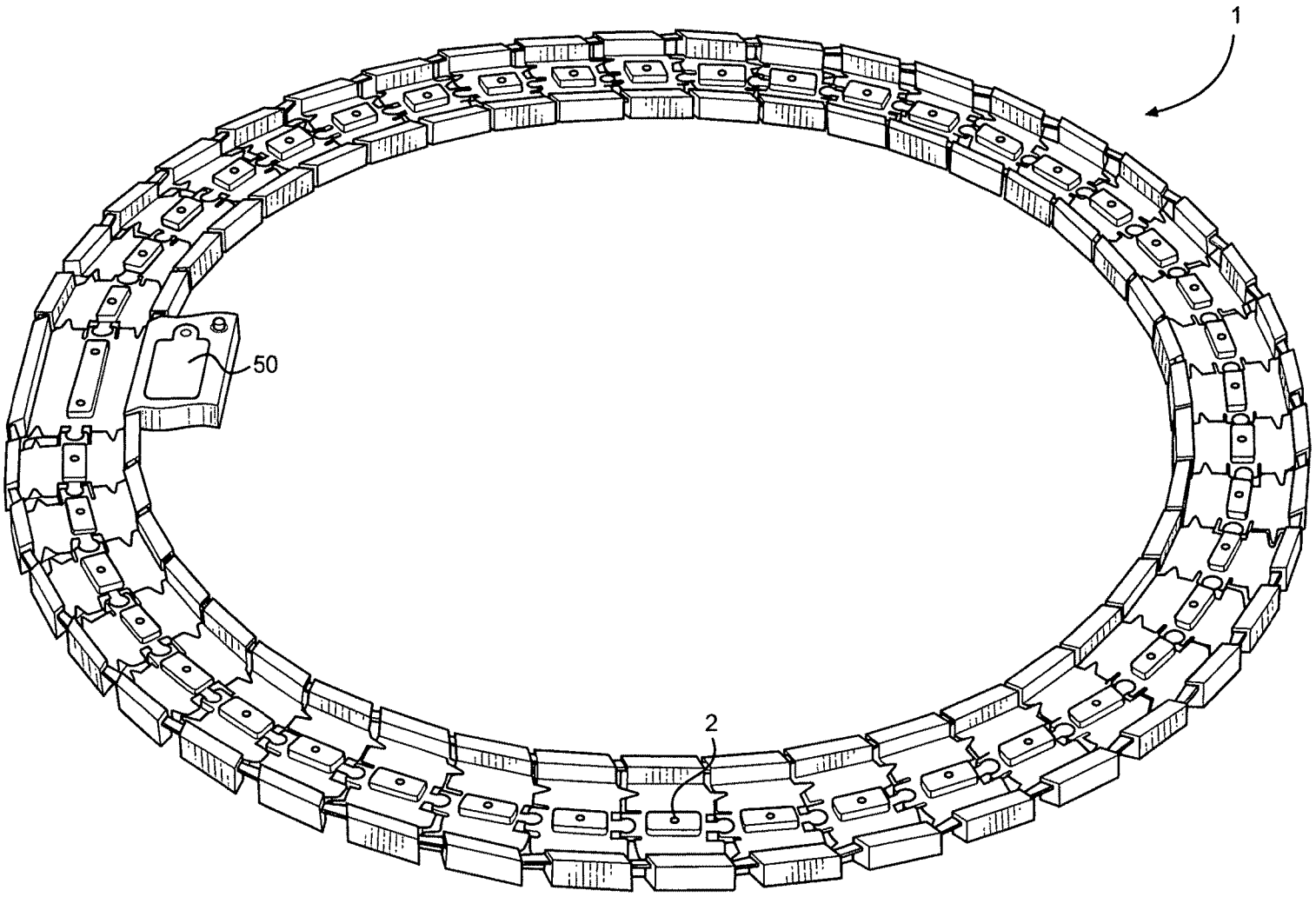
FIG. 2 is a perspective view of the illuminated system.
Figure 3:
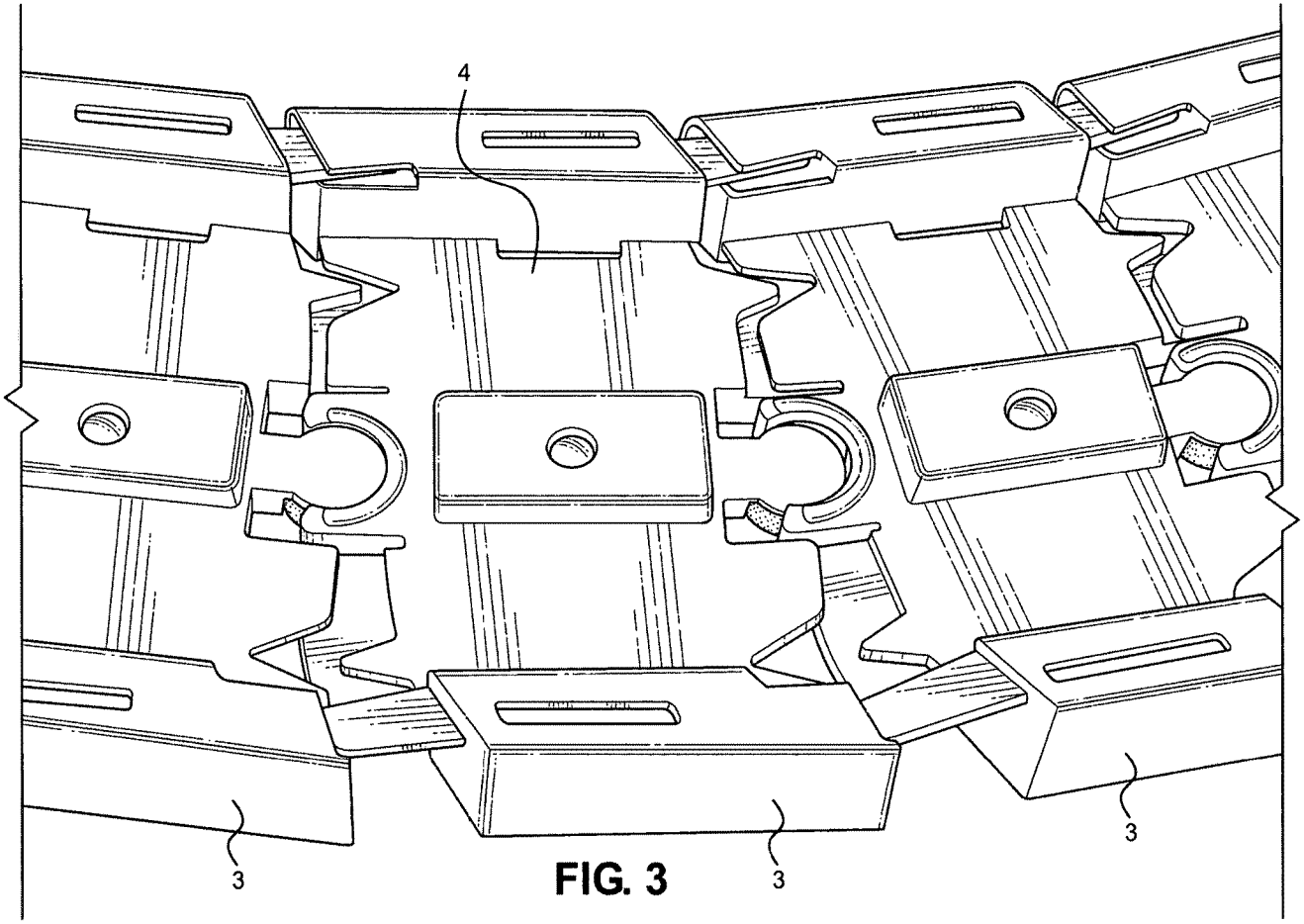
FIG. 3 is a perspective view of conjoined track segments.
Figure 4:
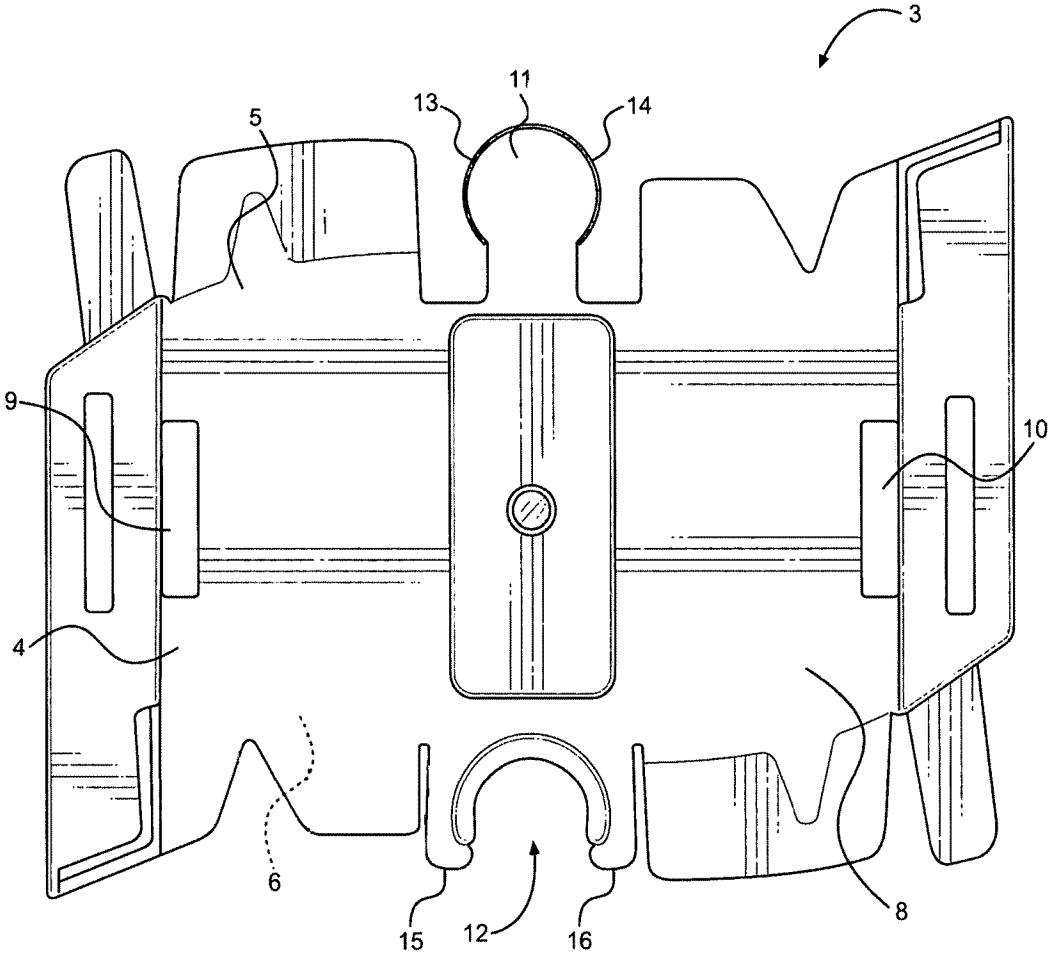
FIG. 4 is a view of the top view of the track segment.
Figure 5:
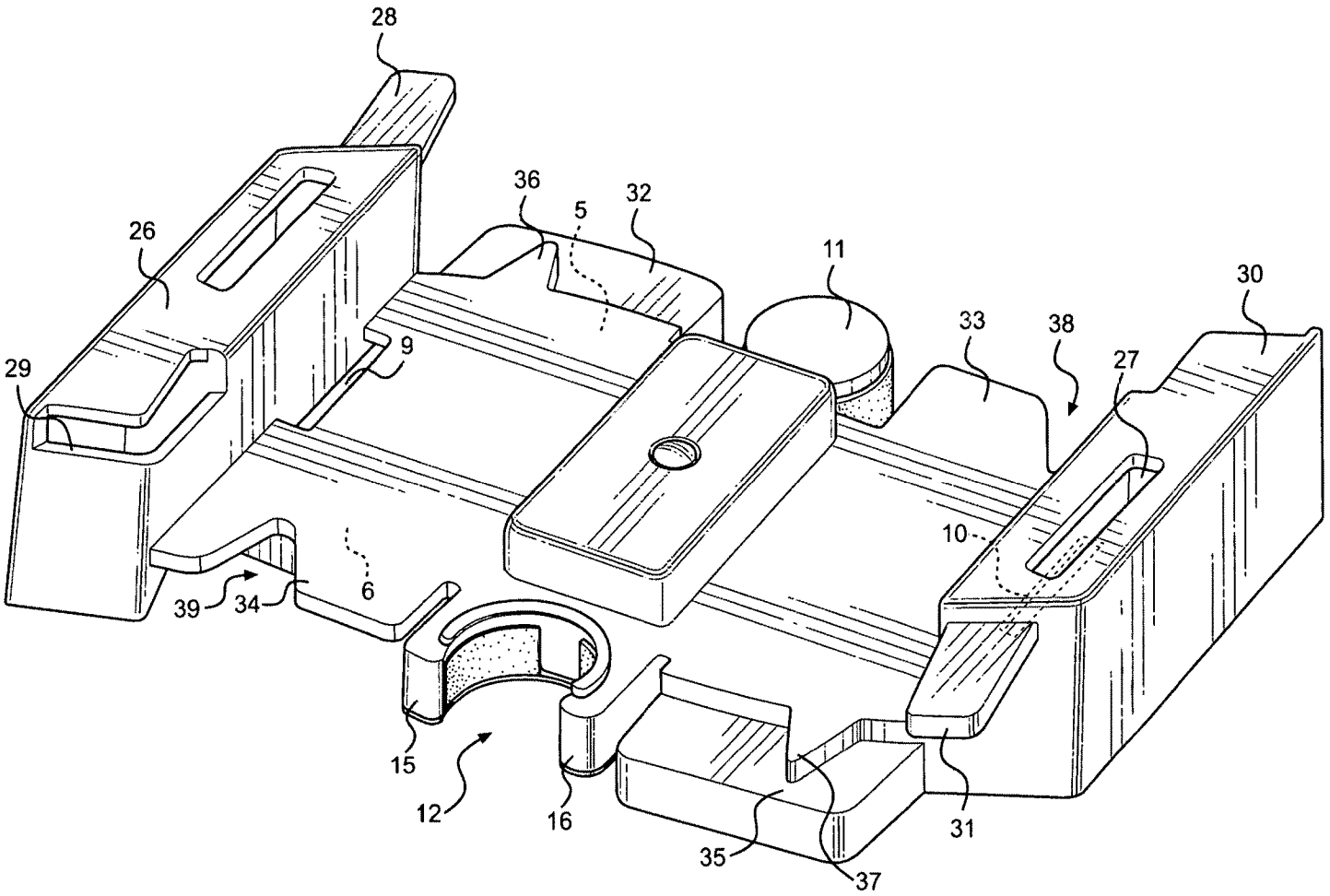
FIG. 5 is a perspective view of the track segment.
Figure 6:
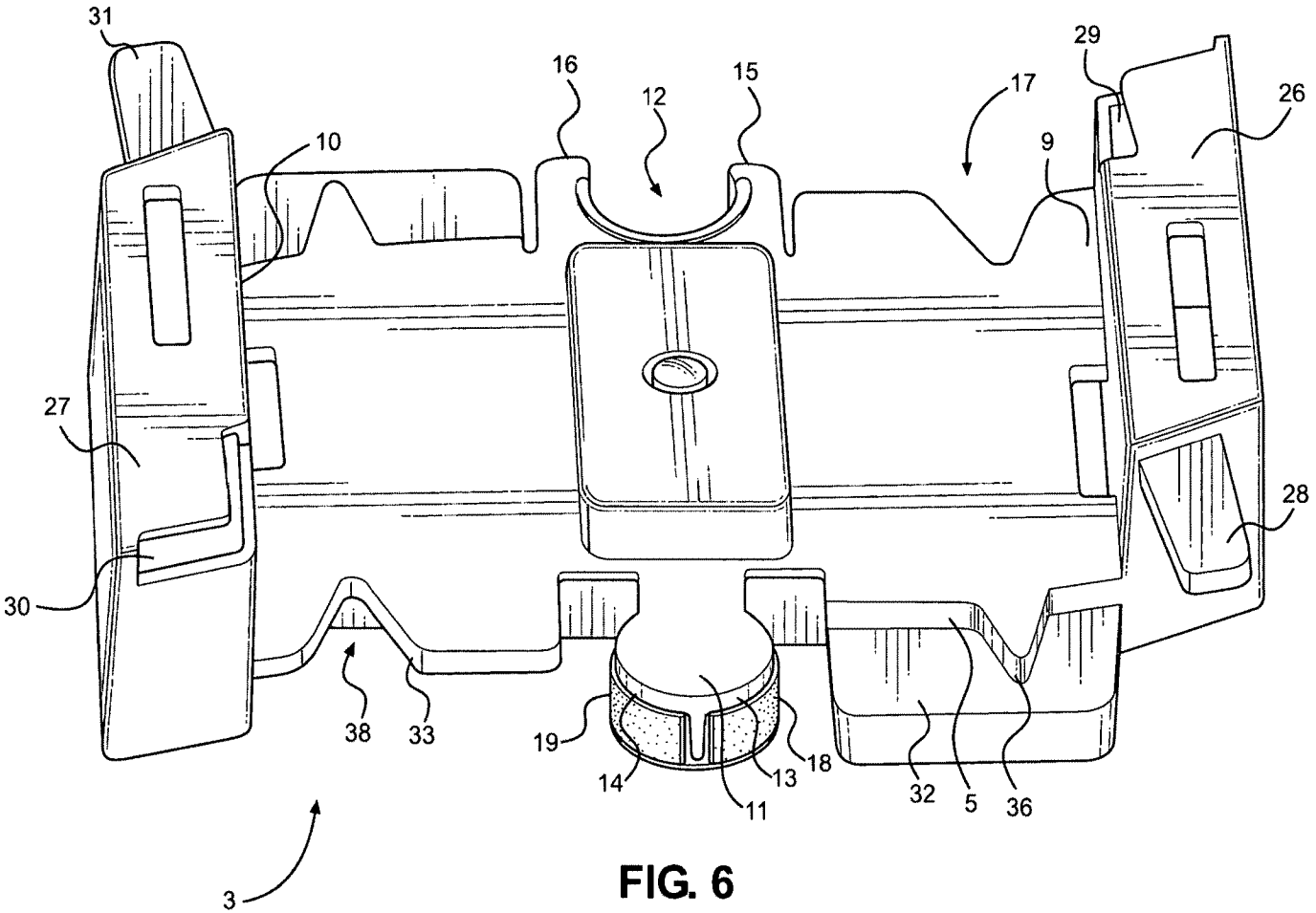
FIG. 6 is a perspective view of the front of the track segment.
Figure 7:
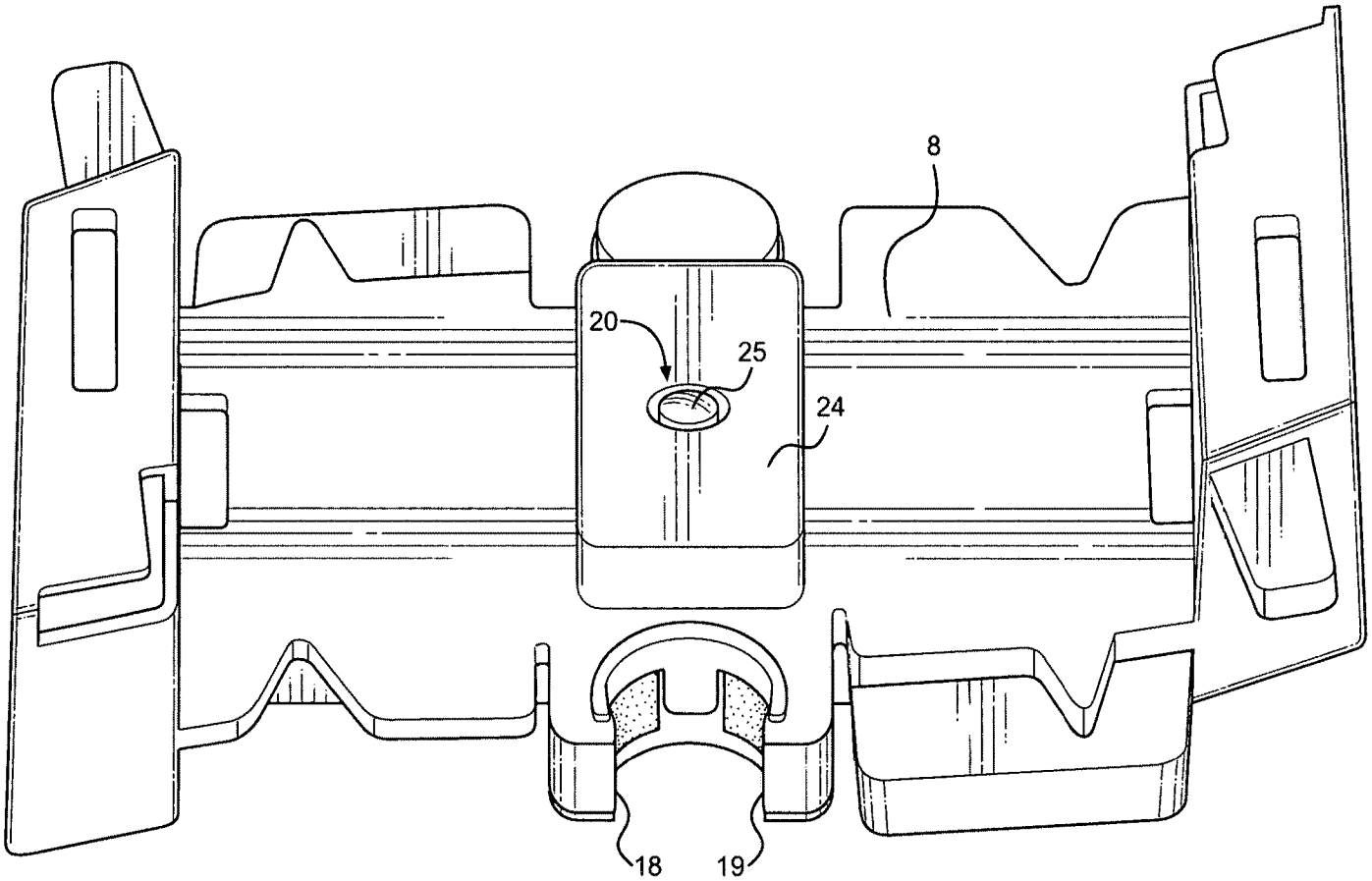
FIG. 7 is a perspective view of the rear of the track segment.
Figure 8:
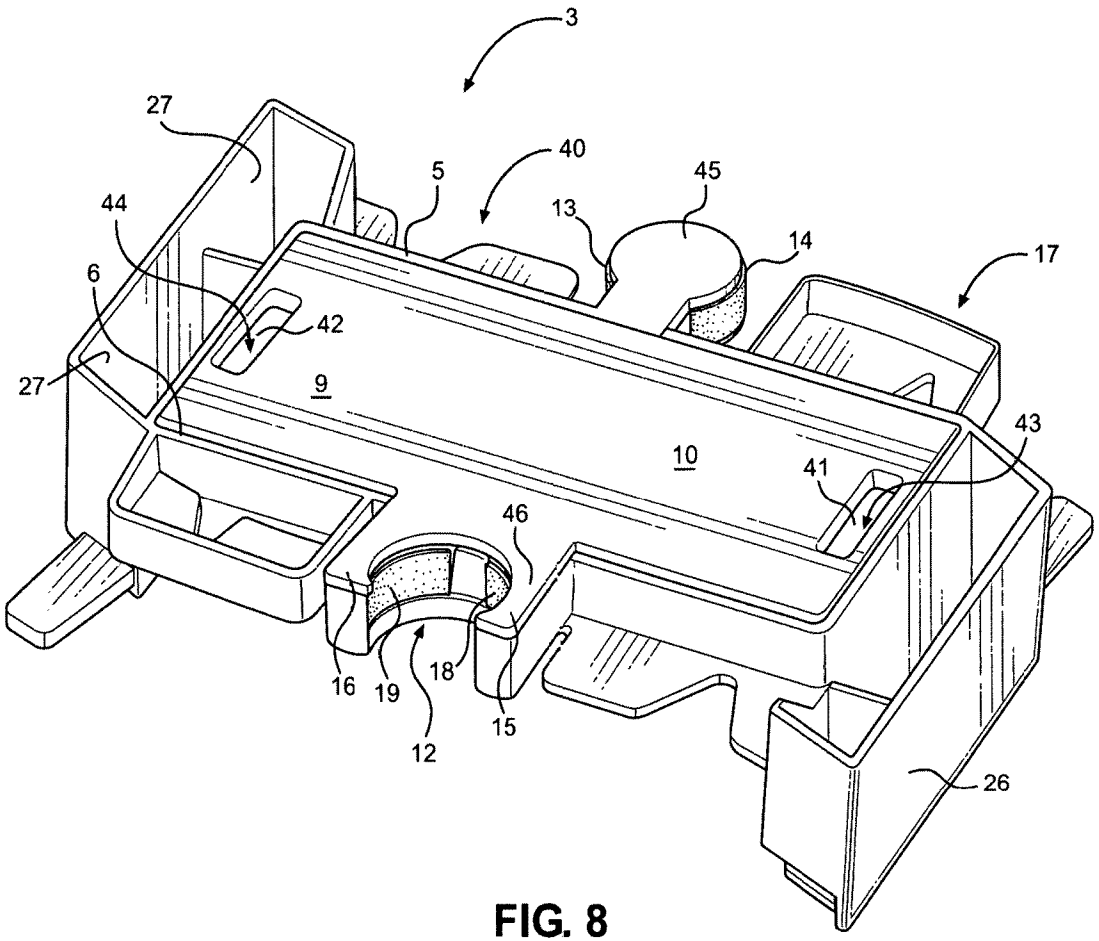
FIG. 8 is an overhead view of the underside of the track segment.
Figure 9:
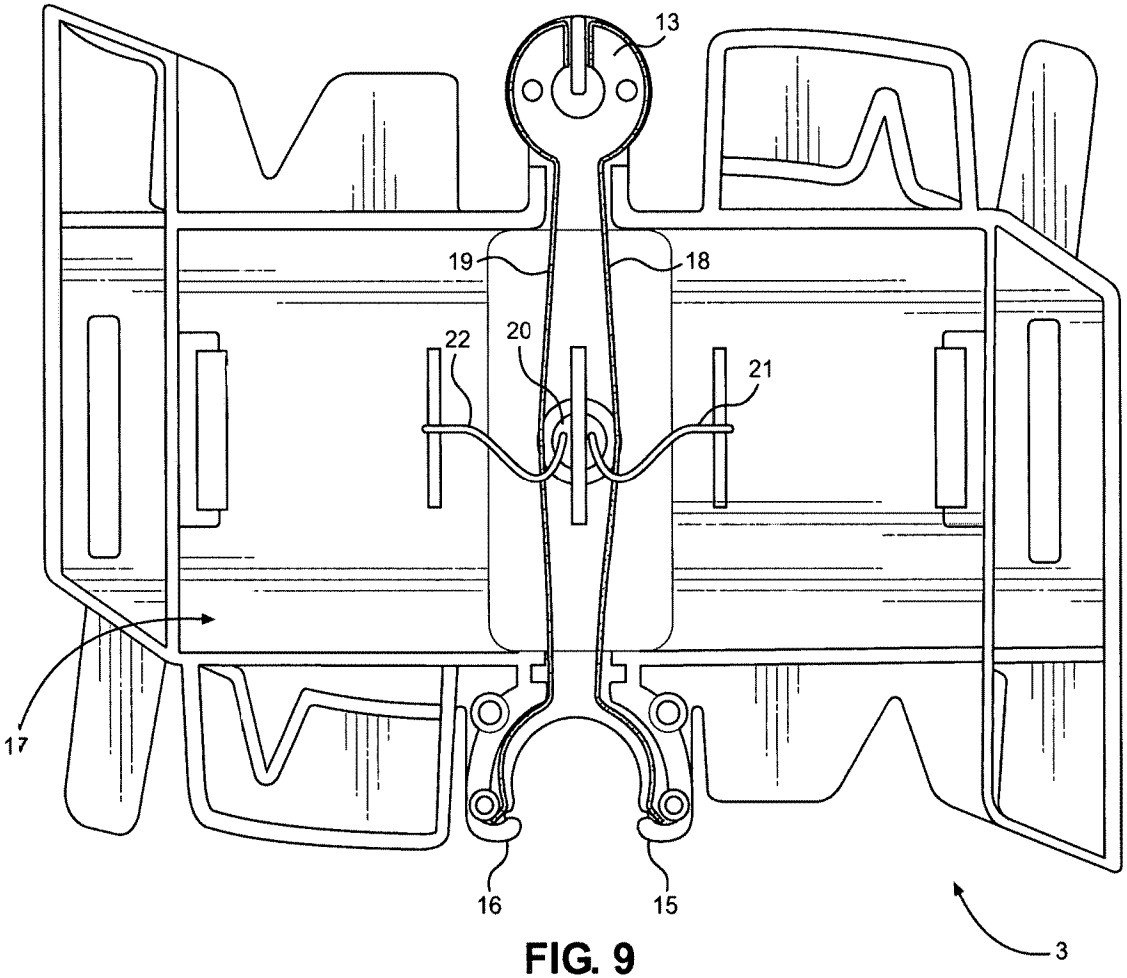
FIG. 9 is a top view of the underside of the track segment without the cover.
Figure 10:
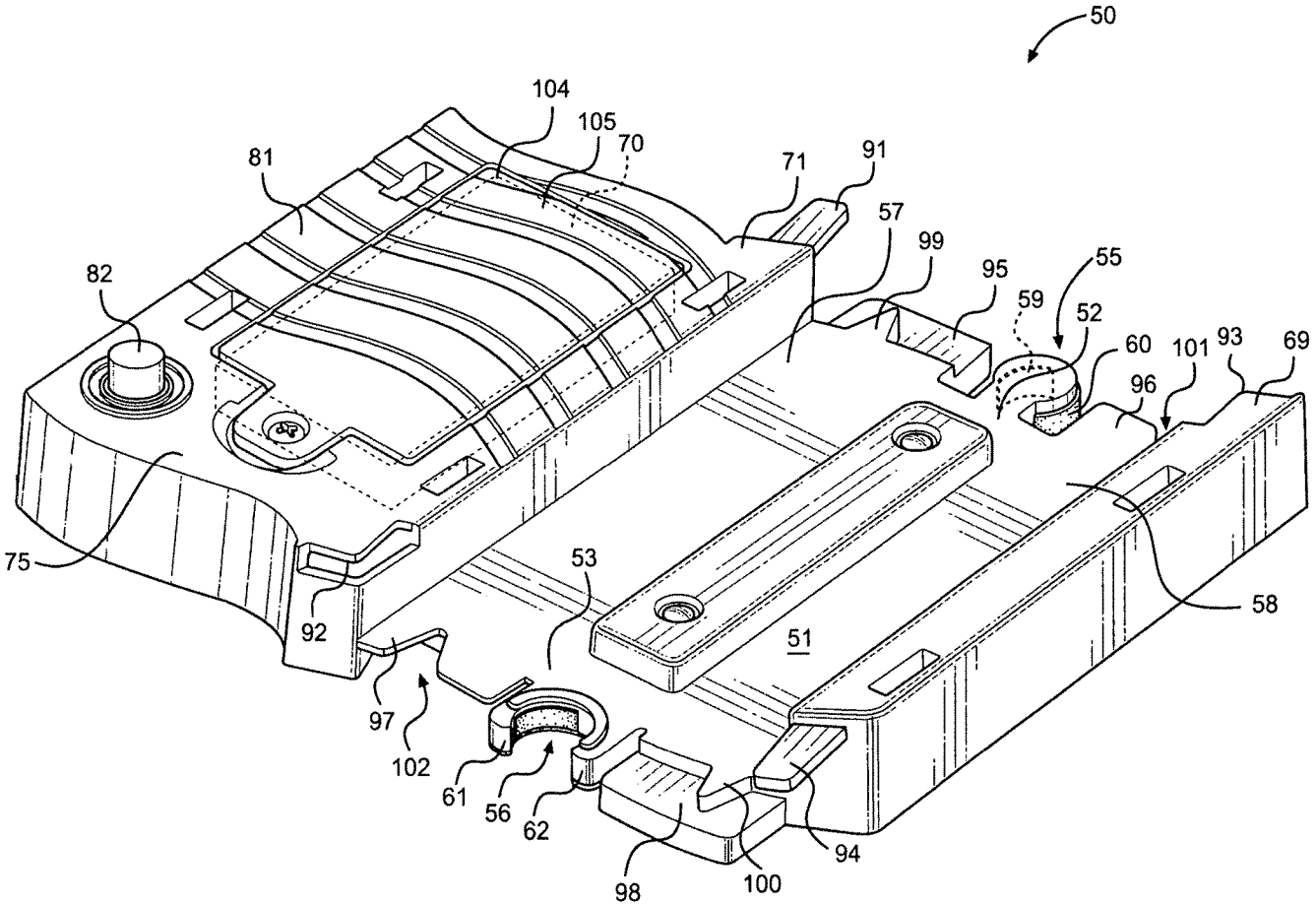
FIG. 10 is a perspective view of the power source segment.
Figure 11:
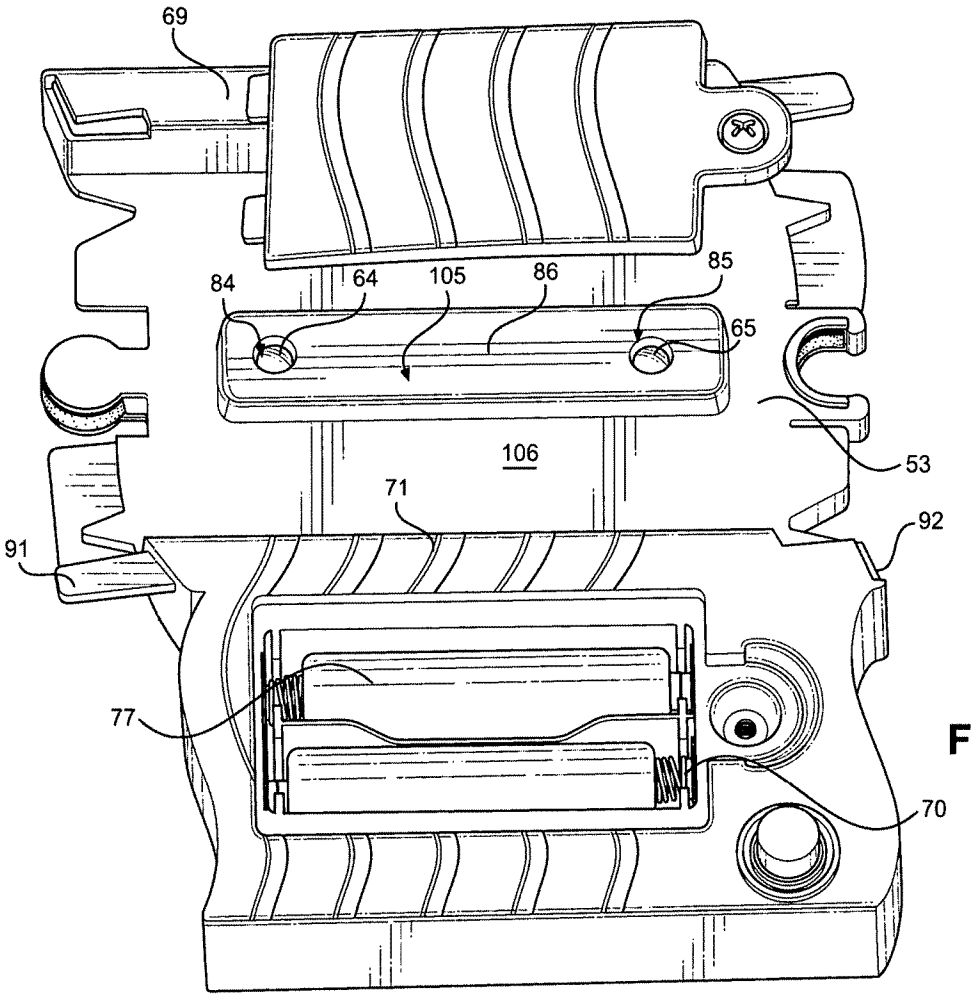
FIG. 11 is an overhead view of the power source.
Figure 12:
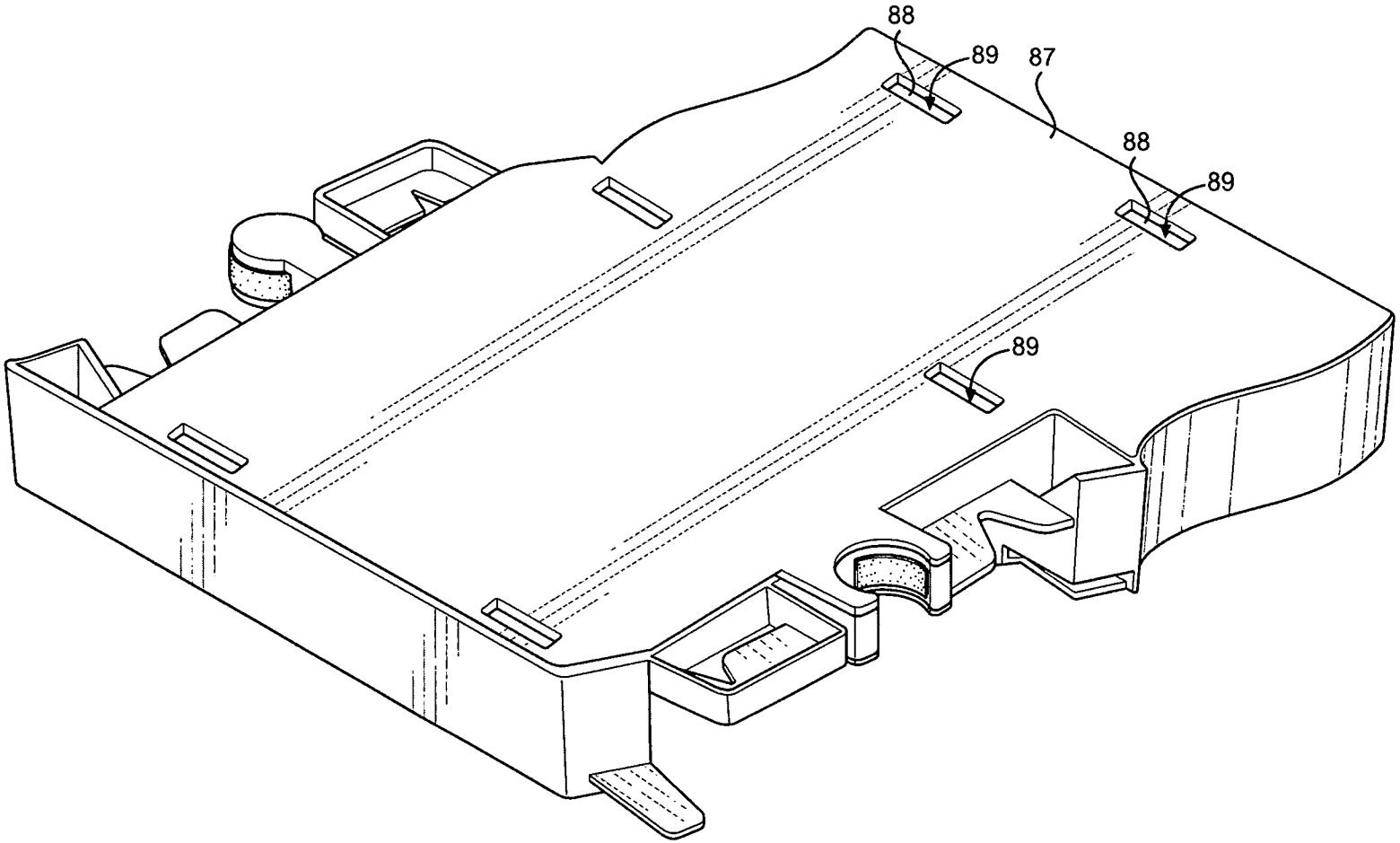
FIG. 12 is a perspective view of the underside of the power source.
Figure 13:
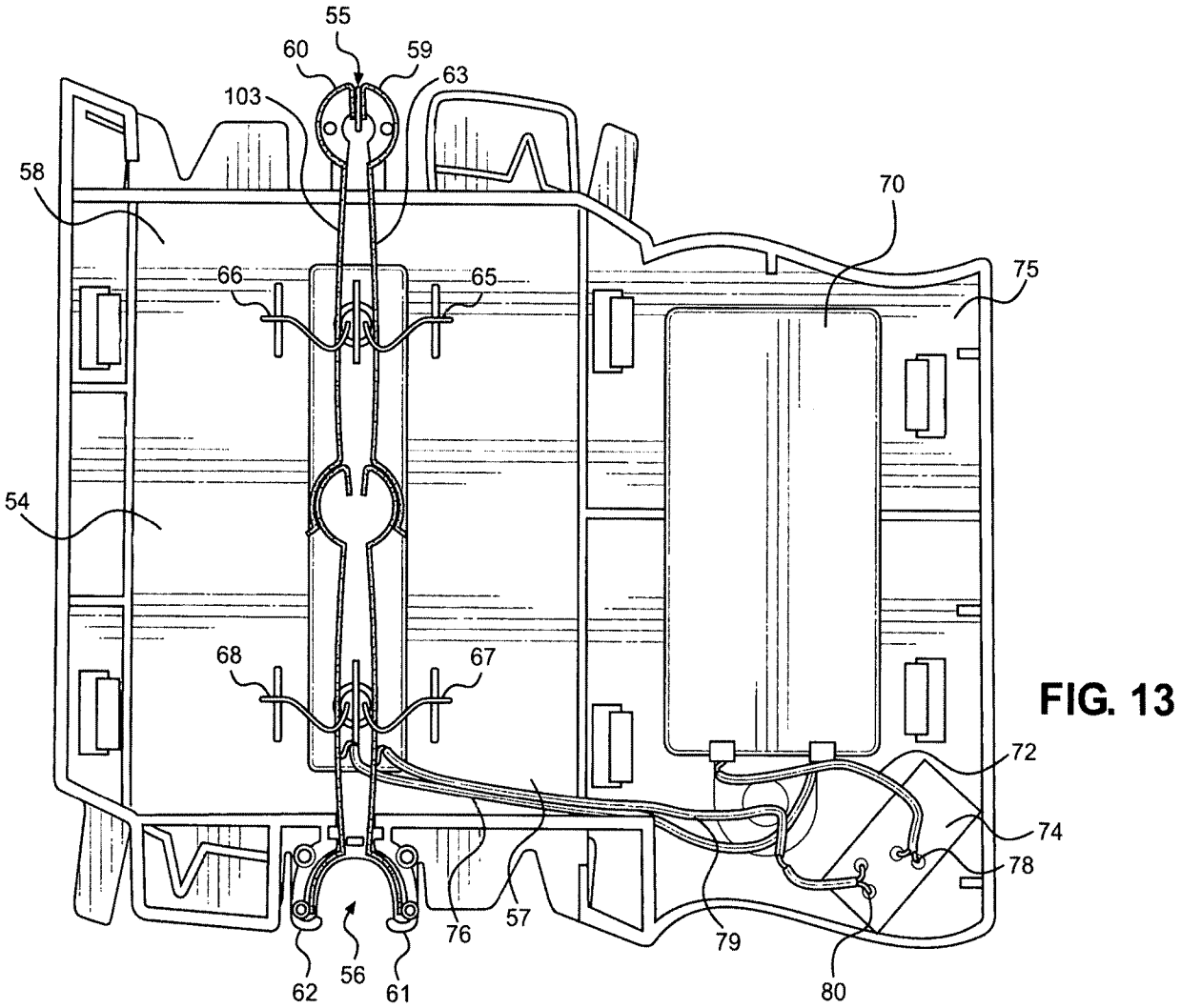
FIG. 13 is a full frontal view of the underside of the power source without the back.

FIGS. 1-12 illustrated an illuminated track system 1, with the source of illumination 2 positioned down the center of the track segments 3. Each track segment comprises a floor 4. A front section 5 is integral and part of floor 4 as is a back section 6, an underside 17, a top section 8, a first side section 9 and a second side section 10.

The front section 5 comprises a coupler 11, and a coupler mouth 12, which is attached to the back section 6. More specifically, each track segment 3 has a front section having a coupler 11 and a back section 6 having a coupler mouth 12. The coupler 11 has a left coupler side 13 and a right coupler side 14 and the coupler mouth 12 has a left coupler mouth side 15 and a right coupler mouth side 16. The track segment 3 is made out of plastic, and the various parts are integral.

The track segment 3 also has an underside 17. The underside contains 17 a first conductive contact 18 connecting said left coupler side 13 at the front section 5 of a track segment 3 to said left coupler mouth side 15 on the same track segment 3. It should be noted that the underside 17 also contains a second conductive contact 19 connecting said right coupler side 14 at the front section 5 of a track segment 3 to said right coupler mouth side 16 on the same track segment 3. In one embodiment, the conductive contacts 18, 19 are strips of copper.

The underside 17 also contains an illumination device 20. In one embodiment, the illumination device 20 is an LED, with wires 21, 22 touching or connected to first conductive contact 18 and first conductive contact 19.

The floor 4 also has a top section 8. In one embodiment, there is an opening for each of said LEDS to fit in through the top section. More specifically, in one embodiment the top section 8 has a top raised middle section 24 through which there is an opening 25 for the LED 20 to emerge.

The coupler and the coupler mouth serve two functions. They allow the track segments 3 to be joined together. Second, they allow the power to pass through the track segments 3.

The track segment 3 also has a first side wall 26 and a second side wall 27. The first side wall 26 is integral with the first side section 9 and the second side wall 27 is integral with the second side section 10. The first side wall 26 has a first coupling arm 28 near the front section 5 on the first side wall 26 and a first coupling pocket 29 on the first side wall 26 near the back section 6. The second side wall 27 of the track segment 3 has a second coupling pocket 30 near the front section 5 on said second side wall 27 and a second coupling arm 31 near the back section 6 of the second wall 27.

In an alternative embodiment, the arrangement of the coupling arm 28 and the coupling pocket 29 can be reversed, so, for example, the first side wall 26 has a first coupling pocket 29 near the front section 5 on the first side wall 26 and a first coupling arm 28 on the first side wall 26 near the back section 6. The same rearrangement can be made for the second side wall.

There is another means of attachment. In one embodiment, the track segment 3 further contains a first underlay 32 extending from the front section 5 of the first side section 9, and a first overlay 33 extending from the front section 5 of the second side section 10. Furthermore, in one embodiment, the track segment 3 contains a second overlay 34 extending from said back section 6 of said first side section 9 and a second underlay 35 extending from said back section 6 of said second side section 10.

In one embodiment on said underlays 32, 35 there are triangular projections 36, 37 which fit into cutouts 38, 39 in the overlays 33, 35.

In another embodiment, the track segment 3 further contains a first overlay extending from the front section 5 of the first side section 9, and a first underlay extending from the front section 5 of the second side section 10. Furthermore, in one embodiment, the track segment 3 contains a second underlay extending from said back section 6 of said first side section 9 and a second overlay extending from said back section 6 of said second side section 10.

The track segment 3 also has a removal back panel 40, held by two prongs 41, 42 which fit through two openings 43, 44 in the back panel. The prong 41 is positioned next to and parallel with first side wall 26 and prong 42 is positioned next to and parallel with second side wall 27. The back panel 40 also serves as the bottom cap 45 of the coupler 11 and a bottom cap 46 of the coupler mouth 12.

The track is either powered by AC power or by DC power. A standard rectifier can be attached to the first conductive contact 18 and the second conductive contact 19.

In another embodiment, the track system includes a power source track segment 50. The power source track segment 50 contains a floor 51. The floor 51 comprises a front section 52 and a back section 53, as well as an underside 54. The front section 52 also has a coupler 55, and the back section 53 has a coupler mouth 56. There is also a first side section 57 and a second side section 58. The coupler 55 has a left coupler side 59 and a right coupler side 60 and the coupler mouth 56 has a left coupler mouth side 61 and a right coupler mouth side 62.

On the underside 54 a first conductive contact 63 connects said left coupler side 59 to said left coupler mouth side 61 on said first side section 57. Also on the underside 54 is a second conductive contact 103 which connects said coupler 60 to said coupler mouth 62 on said second side section 58. The first and second conductive contacts 63, 103 are, in one embodiment, made out of copper.

The power source track segment 50 also comprises a top section 104. At least one illumination bulb 64 or at least two illumination bulbs 64, 65 are positioned from the underside 54 and connected to said first conductive contact 63 and to said second conductive contact 103 by contact wires 65, 66, and contact wires 67 68. In one embodiment, the illumination bulbs 64, 65 are LEDs. In another embodiment, there are openings 84, 85 through the top section 104 into which the bulbs fit. In another embodiment, the middle 86 of the top section 104 is elevated 105.

In another embodiment, the power source track segment 50 also has a first side wall section 71, a power source 70, said power source 70 attached to a second side section 71. The second side section 69 can be integral with the power source 70, wherein the power source 70 is contained within an integral power source enclosed appendage 75. A first conductive contact wire 72 connects the power source with the a first contact 78 on switch 74, which in this case has a circuit board. In this case the power source 70 is a battery pack 77. In one embodiment, the battery pack uses two "AA" batteries. A second conductive contact wire 76 connects the power source to the second conductive contact 103. A third conductive contact wire 79 connects a second contact 80 on switch 74 to the first conductive contact 61. On the top side 81 of the power source segment 50, a button 82 is pushed, illuminating the track pieces that are connected to one another, as long as one of the connected pieces is the power source track segment 50. On the underside 54 also has a removable back lid 87. The removable back lid 87 is held in place by a plurality of prongs 88, which fit within a plurality of slits 89.

The top section 104 also contains a removable cover 105 over the battery pack 77, as well as the button 82 for the power switch 74.

The power source track segment 50 also has the same features as the other track segments 3. The first side wall 71 has a first coupling arm 91 near the front section 52 and a first coupling pocket 92 on the first side wall 71 near the back section 53. The second side wall 69 of the power source track segment 50 has a second coupling pocket 93 near the front section 52 and a second coupling arm 94 near the back section 53 of the second wall 69. In another embodiment, the coupling arm and the coupling pocket are in reverse positions on the first side wall 71 and the second side wall 69.

The power source track segment 50 also contains another means of attachment. In one embodiment, the power source track segment 50 further contains a first underlay 95 extending from the front section 52 of the first side section 57, and a first overlay 96 extending from the front section 52 of the second side section 58. Furthermore, in one embodiment, the power source track segment 50 contains a second overlay 97 extending from the back section 53 of said first side section 57 and a second underlay 98 extending from said back section 53 of said second side section 58.

In one embodiment on said underlays 95, 98 there are triangular projections 99, 100 which fit into cutouts 101, 102 in the overlays 96, 97.

In another embodiment, the power source track segment 50 further contains a first overlay extending from the front section 52 of the first side section 57, and a first underlay extending from the front section 52 of the second side section 58. Furthermore, in one embodiment, the power track segment 50 contains a second underlay extending from said back section 53 of said first side section 57 and a second overlay extending from said back section 57 of said second side section 58.

Although the disclosure has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of disclosures(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. An illuminated track system, comprising:

a) a plurality of track segments, each track segment comprising:
  i) a floor, said floor comprising:
    A) a front section, said front section comprising a coupler;
    B) a back section, said back section comprising a coupler mouth;
    C) an underside, said underside comprising:
      I) a first conductive contact connecting said coupler to said coupler mouth;
      II) a second conductive contact connecting said coupler to said coupler mouth;
    D) a top section;
    E) at least one illumination bulb, said illumination bulb positioned from said underside and connected to said first conductive contact and to said second conductive contact;
    F) a first side section;
    G) a second side section; and b) a power source, wherein said power source is connected to an assembly of said plurality of said track segments, such that said assembly forms a closed circuit.

2. The illuminated track system of claim 1, wherein said power source is batteries.

3. The illuminated track system of claim 1, wherein said power source is AC current.

4. The illuminated track system of claim 1, wherein said power source is included in a power source track segment, said power source track segment comprising:

i) a floor, said floor comprising:
  A) a front section, said front section comprising a coupler;
  B) a back section, said back section comprising a coupler mouth;
  C) an underside, said
  D) a first conductive contact connecting said coupler to said coupler mouth;
  E) a second conductive contact connecting said coupler to said coupler mouth;
  F) a top section;

G) at least one illumination bulb, said positioned from said underside and connected to said first conductive contact and to said second conductive contact;

G) a first side section;

H) a second side section;

I) a power source, said power source attached to said second side section, wherein said power source is connected to the first conductive contact and said second conductive contact.

5. The illuminated track system of claim 1, wherein said at least one illumination bulb is an LED light.

6. The illuminated track system of claim 1, wherein said top section of said floor has at least one opening for a light from underneath the track segments.

7. The illuminated track system of claim 6, wherein said middle section of said floor has a raised section through said at least one light fits.

8. The illuminated track system of claim 1, further comprising a first side wall attached to said first side section.

9. The illuminated track system of claim 8, further comprising a second side wall attached to said second side section.

10. The illuminated track system of claim 9, said first side wall of said track segment comprising:

a) a first coupling arm near said front section on said first side wall; and b) a first coupling pocket near said back section on said first side wall.

11. The illuminated track system of claim 10, said second side wall of said track segment comprising:

a) a first coupling pocket near said front section on said second side wall; and b) a first coupling arm near the back section on said on said second wall.

12. The illuminated track system of claim 9, said first side wall of said track segment comprising:

a) a first coupling arm near said back section on said first side wall; and b) a first coupling pocket near said front section of said first side wall.

13. The illuminated track system of claim 12, said first said side wall of said track segment comprising:

a) a first coupling pocket near said back section on said second side wall; and b) a first coupling arm near the front section on said on said second wall.

14. The illuminated track system of claim 1, wherein said track segment further comprises:

a) a first overlay extending from said front section of said first side section;

b) a first underlay extending from said front section of said second side section;

c) a first underlay extending from said back section of said first side section;

d) a first overlay extending from said back section of said second side section.

15. The illuminated track system of claim 1, wherein said track segment further comprises:

a) a first underlay extending from said front section of said first side section;

b) a first overlay extending from said front section of said second side section;

c) a first overlay extending from said back section of said first side section;

d) a first underlay extending from said back section of said second side section.

* * * * *